US005328072A

United States Patent [19]

Ruessmann et al.

[11] Patent Number: 5,328,072

[45] Date of Patent: Jul. 12, 1994

[54] DEVICE FOR LOCATING THE EDGES OF MOVING WEBS

[75] Inventors: Gerd Ruessmann, Heidenheim; Helmut Lieberg, Schongau, both of Fed. Rep. of Germany

[73] Assignee: J.M. Voith GmbH, Heidenheim, Fed. Rep. of Germany

[21] Appl. No.: 377,846

[22] PCT Filed: Oct. 5, 1988

[86] PCT No.: PCT/EP88/00882

§ 371 Date: Jun. 16, 1989

§ 102(e) Date: Jun. 16, 1989

[87] PCT Pub. No.: WO89/03357

PCT Pub. Date: Apr. 20, 1989

[30] Foreign Application Priority Data

Oct. 17, 1987 [DE] Fed. Rep. of Germany ..... 3735202

[51] Int. Cl.[5] ..... B65H 23/02; G02B 5/14

[52] U.S. Cl. ..... 226/15; 250/227.26; 250/227.24; 250/548; 226/20; 226/45

[58] Field of Search ..... 226/3, 15, 45, 20; 250/202, 227.26, 227.24, 548, 559, 561, 227.28

[56] References Cited

U.S. PATENT DOCUMENTS

| | | | |
|---|---|---|---|
| 3,501,642 | 3/1970 | Wastesson | 226/20 X |
| 3,606,119 | 9/1971 | Callan | 226/20 |
| 4,021,031 | 5/1977 | Meihofer et al. | 226/20 |
| 4,384,686 | 5/1983 | Wiley et al. | 226/20 X |
| 4,409,477 | 10/1983 | Carl | 250/227.28 X |
| 4,469,941 | 9/1984 | Palmer | 250/227.28 X |
| 4,472,052 | 9/1984 | Löfgren | 250/551 X |
| 4,720,629 | 1/1988 | Parker | 250/202 |
| 4,848,632 | 7/1989 | Mack et al. | 226/20 X |

FOREIGN PATENT DOCUMENTS 1507938 4/1978 United Kingdom .

*Primary Examiner*—Daniel P. Stodola
*Assistant Examiner*—Paul Bowen
*Attorney, Agent, or Firm*—Baker & Daniels

[57] ABSTRACT

A device for continuously determining the position of the edge of a moving web uses a light signal from a light relay emitted in the direction of the edge of a web. The light signal is received and converted by the light relay into an input/output signal which is used as an indicator and as a control value for the position of the edge of the web. The signal outlet is moved together with the signal input preferably along a circular path which intersects the edge of the web twice so that the position of the edge of the web can be determined from the corresponding input/output signals obtained during each revolution.

2 Claims, 5 Drawing Sheets

DEVICE FOR LOCATING THE EDGES OF MOVING WEBS

Figure 1:
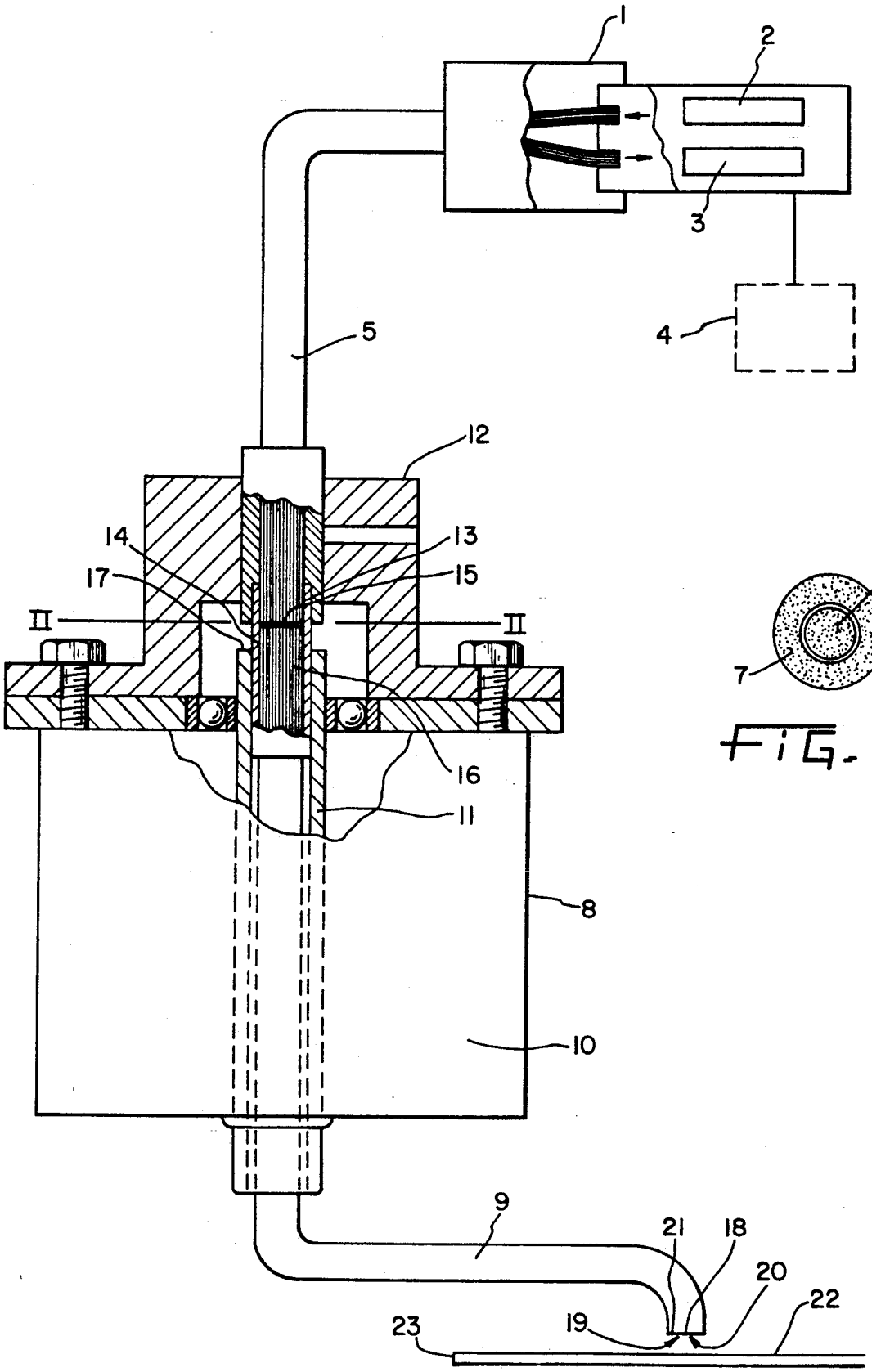

The invention concerns a process for locating the edges of moving webs, such as paper webs, dryer felts, wire screens, textiles, foils and similar, where a light signal of a photoelectric relay is emitted from a signal output arranged in the area of the web edge, toward the web edge, and the reflected or unreflected light signal is received by a signal input and converted by the photoelectric relay to an on/off signal which is used for display and as a control variable for the position of the web edge.

In the control of revolving machines of any kind where web type materials are being moved, monitoring the web edges with regard to tracking is indispensable in order to avoid damage to either the machine or to the web itself. Examples are paper webs, dryer felts in paper machines, wire screens, textiles, foils and similar. Basically the same applies to the measurement of coil diameters on winders, unwinders and coilers, where all of the measures required for actual value acquisition in all areas of this type need to take place without contact, since even the slightest contact forces are harmful to the measuring object.

In many cases, however, for instance on the wires and dryer felts of paper machines, mechanical scanners are used in practice which upon contact with the web edge effect an electronic or pneumatic control. Very popular, this procedure may easily cause damage to the measured material through friction on the web edges, especially in the case of high-speed machines.

In a prior process of the initially cited type, though, the actual value is captured optically and without contacting the measured material, but there are two photoelectric relays used here which through pistons control a guidance device. The disadvantage of this prior procedure is that locating a web edge requires already two photoelectric relays between which the actual value for the web edge position is located. Consequently, also the locating of the web edge is comparatively inaccurate. Additionally, this type of actual value acquisition for the web edge requires a guidance system that is pulsed through magnetic valves and has a comparatively complex structure. In this prior process, the actual value is determined by meeting the condition that one photoelectric relay is covered whereas the other is exposed. Naturally, this condition entails also startup problems, since this condition is met also when the web edge is being approached from outside.

Based on this prior art, the problem underlying the invention is to propose a process of the initially mentioned type and a device for the application of the process where an actual value acquisition is possible that works continuously without contact and optically.

This problem is inventionally solved essentially in that the locating of the web edge is performed continuously in that the signal output and the signal input orbit jointly and constantly on a path which intersects the web edge twice, and in that from the input/output signals obtained in each revolution the respective position of the web edge is determined.

It is obvious that this procedure enables a continuous monitoring of the web edge position which involves no contact whatsoever. To be understood as an orbital trajectory is one—irrespective of whether it is rectilinear or curving—which is self-contained. This continuous actual value acquisition of the web edge makes it possible to design the control section with conventional rules. At the same time it is also possible, e.g., to perform a noncontact measurement of coil diameters on winders and unwinders, so that a travel control for the edge sensor is achievable in a simple manner.

Another advantage is that the process can be performed with a single photoelectric relay and, as will yet be explained in detail farther down in conjunction with the inventional device, enables a distinctly rugged design.

In a preferred embodiment of the invention, the signal output and signal input are being moved along a circular path which intersects the web edge.

In modified embodiments, in detail, it may also be advantageous to convert the circular path first to a linear path which intersects the web edge.

In the inventional process, the angle of intersection is determined from the two intersecting points, whereof the height of the segment of the circle is computed for indicating the web edge position.

The angle of intersection can preferably be measured by integration and averaging of a direct voltage that is switched by the photoelectric relay at the pulse width repetition ratio.

Alternatively, the angle of intersection can be measured by determining the time span between the two input/output signals.

In the inventional embodiment where the circular path is first converted to a linear path that intersects the web edge, the position of the web edge is found by determining the portion of the linear trajectory that is covered by the band and/or the portion that is not covered by the band.

In a device for the application of the process described above, with a photoelectric relay and a signal output and signal input in the area of the web edge which are connected with the photoelectric relay through optical fiber bundles, the problem underlying the invention is solved in that a drive is provided which moves the signal output and the signal input along a trajectory which intersects the web edge at least twice, and in that an evaluating device is provided for the on/off signals of the photoelectric relay that are continuously generated at a clock.

It is obvious that this device enables a decidedly accurate measurement of the intersections of the trajectory with the web edge. Furthermore, the device can be constructed decidedly rugged and, depending on the optical fibers and the drive used, can be decidedly temperature-resistant.

The drive is preferably designed as a rotary drive, specifically as an electric, pneumatic or hydraulic motor or as a transmission driven through a flexible shaft.

An especially preferred embodiment can be created in that the rotary drive features a continuous hollow shaft through which extends the optical fiber bundle which is connected with the transmitter and receiver of the photoelectric relay and in that on the drive shaft of the motor a scanning arm is mounted through which the optical fiber bundle is passed. With this arrangement, the circular trajectory is generated in simplest fashion through the continuous rotary motion of the drive. This embodiment offers the additional advantage that a simple adaptation of the measuring range can be performed by modifying the radius of the scanning arm. Since, as already mentioned above, only the pulse width repetition ratio between the on/off signals is processed, the measurement is additionally independent of the speed of rotation. The design as a rotary drive assures a decidedly rugged construction with few movable parts.

In this embodiment, preference is given to providing on the free end of the scanning arm the signal output and the signal input, whose light-emitting surface is perpendicular to the drive axis.

In detail, the invention may be further developed by accommodating the optical fiber bundle on the input side of the drive in a housing part in a stationary half of an optical rotary coupling and by providing the bordering end of the hollow shaft with a rotary coupling half of the optical rotary coupling which contains the optical fiber bundle extending to the signal input or signal output.

In this embodiment, the optical fiber bundle preferably contains the transmitting fibers and the receiving fibers concentric with one another, since here an especially simple and rugged routing of the signal line is achieved.

The inventional evaluating device is favorably of a design such that it determines the angle of intersection from the on/off signals by integration and averaging of a direct voltage which is switched by the photoelectric relay at the pulse width repetition ratio.

Alternatively, it is also possible to design the evaluating device in a way such that locating the position is performed by determining the duration of the on/off intervals at the point of intersecting the web edge.

An inventional embodiment modified in an especially favorable way is characterized in that the optical fiber bundle of the scanning arm is connected with the transmitter of the photoelectric relay, in that along the circular trajectory of the signal output there are the ends of connecting optical fiber bundles arranged that form a transmission distributing circle, and in that the other ends of the connecting optical fiber bundle are combined in a linear transmission strip that extends perpendicular to the web edge.

The receiver of the photoelectric relay favorably connects through an optical fiber bundle with a receiver strip in which the free ends of the optical fibers are located linearly side by side.

Additionally it is preferred to arrange the receiver strip parallel to the transmitter strip and for both to intersect the web edge at a right angle.

In a device for the application of the process with a photoelectric relay and with a signal output and signal input in the area of the web edge that are connected with the photoelectric relay, the problem underlying the invention is solved also in that within the path of the rays of the beam emitted by the signal output there is a mirror located that is connected with a drive and can be moved by the drive for generating a path which is followed by the beam and which intersects the web edge.

This device has only few moving parts and operates without contact. It also enables an accurate measurement of the intersecting points of the trajectory of the light beam with the web edge. The transmitter emitting the light beam may be arranged a relatively large distance from the web edge.

According to suitable embodiments of the invention, the mirror may be a plane mirror which is driven in oscillating fashion or a polygonal mirror driven in rotary fashion.

Further favorable details of the invention are set forth in the subclaims or derive from the following description which explains the invention in greater detail with the aid of embodiments illustrated in exemplary fashion in the drawings.

Figure 2:
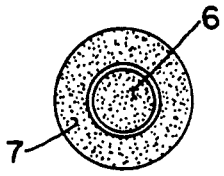
Figure 3:
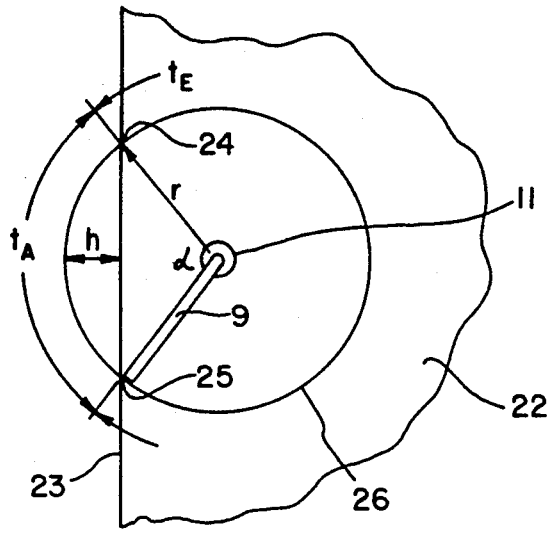
Figure 4:
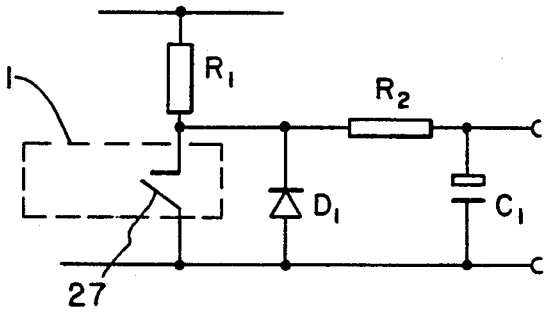
Figure 6:
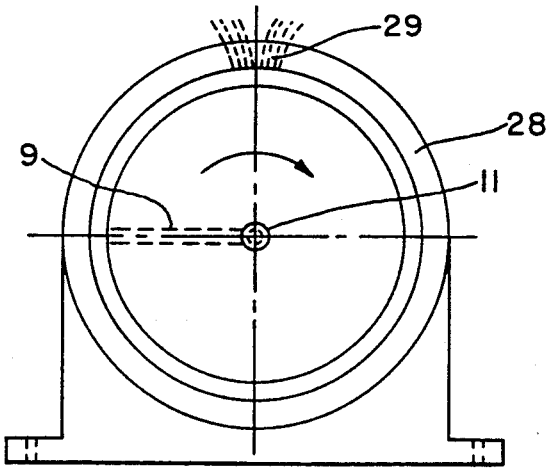
Figure 5:
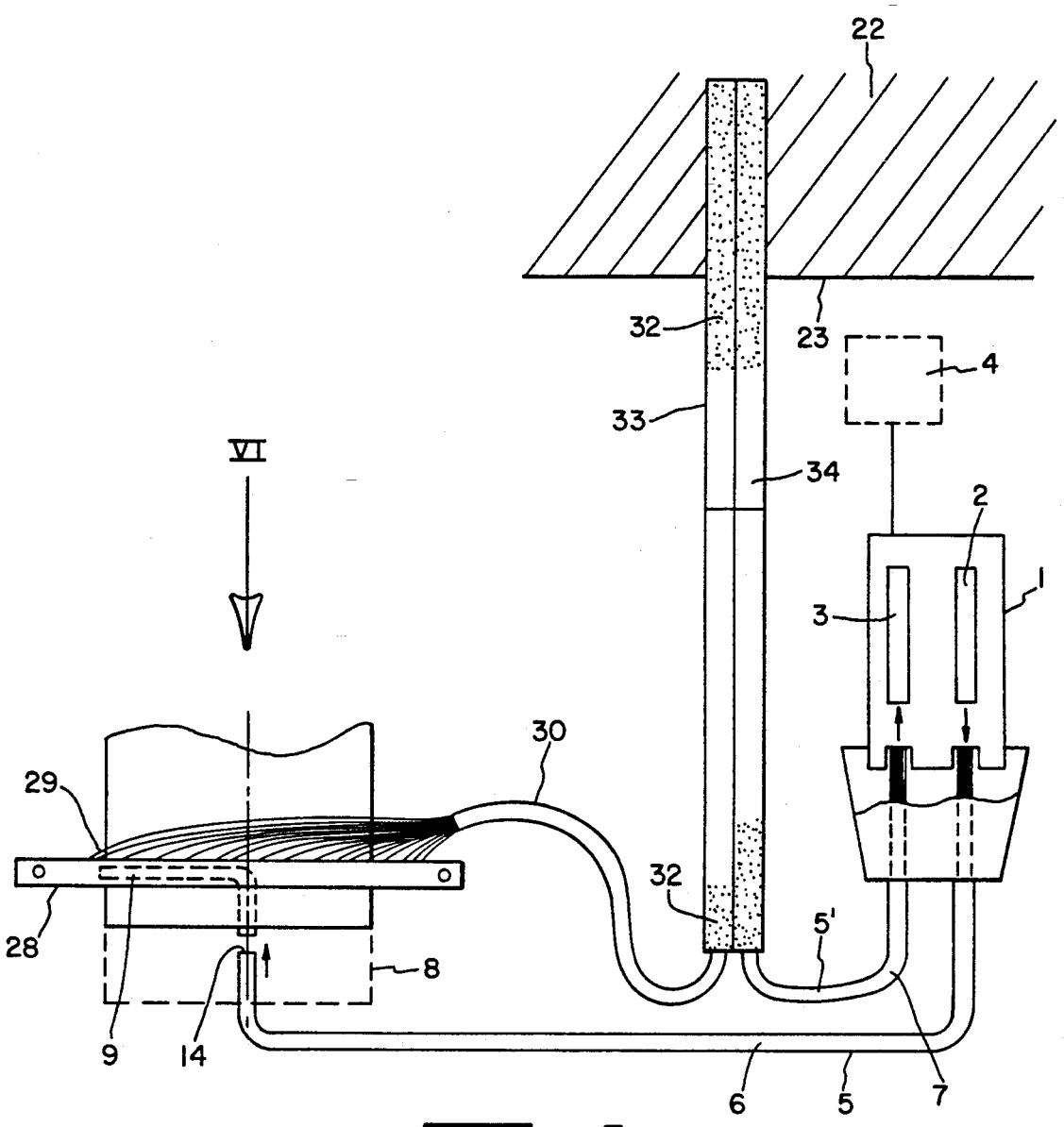
Figure 11:
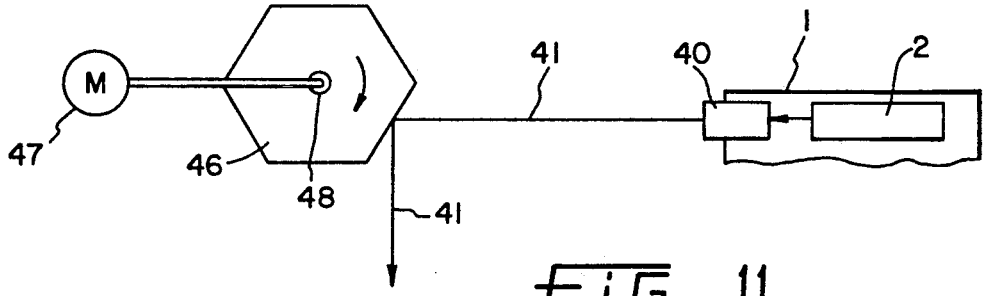
Figure 7:
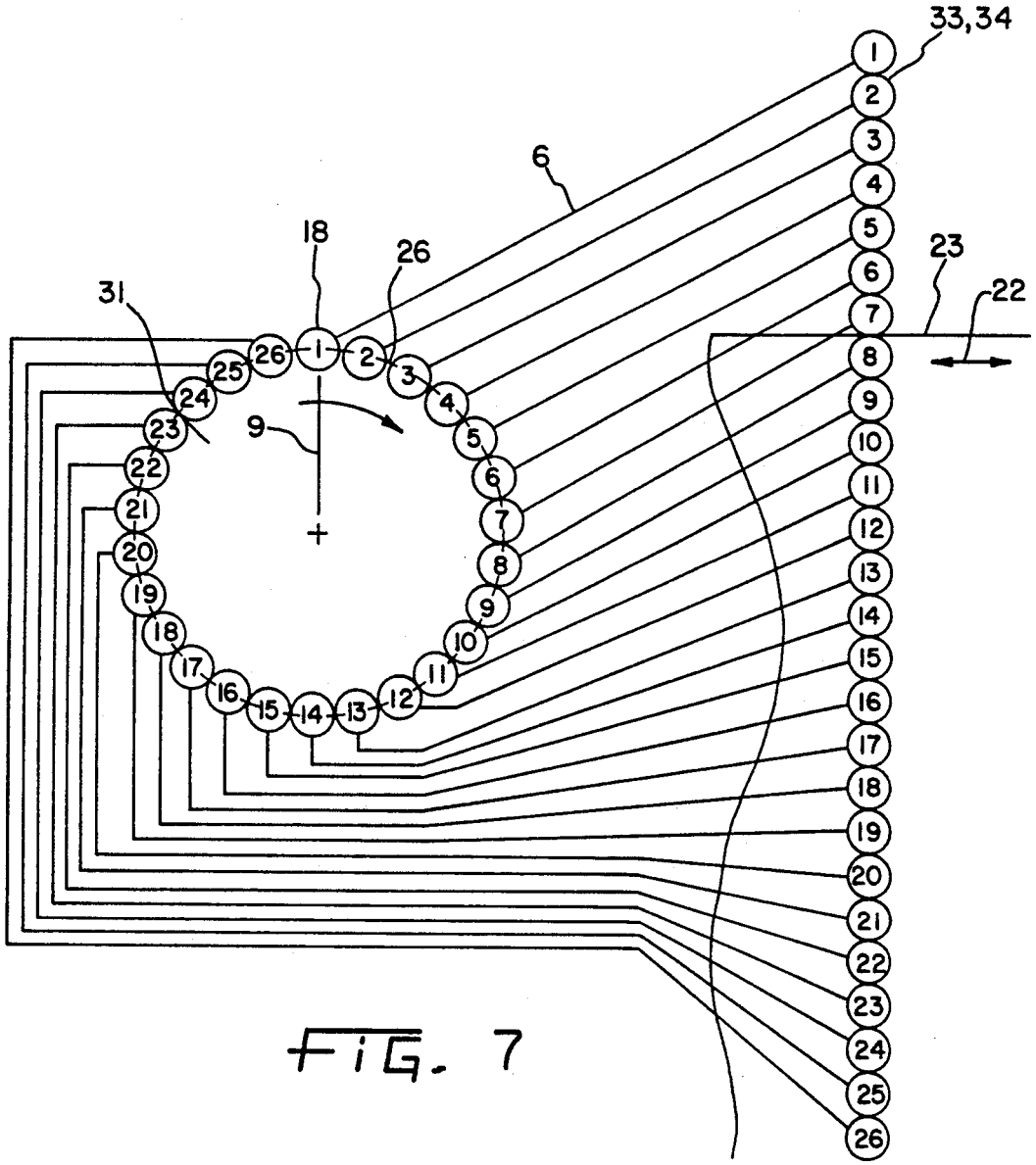
Figure 10:
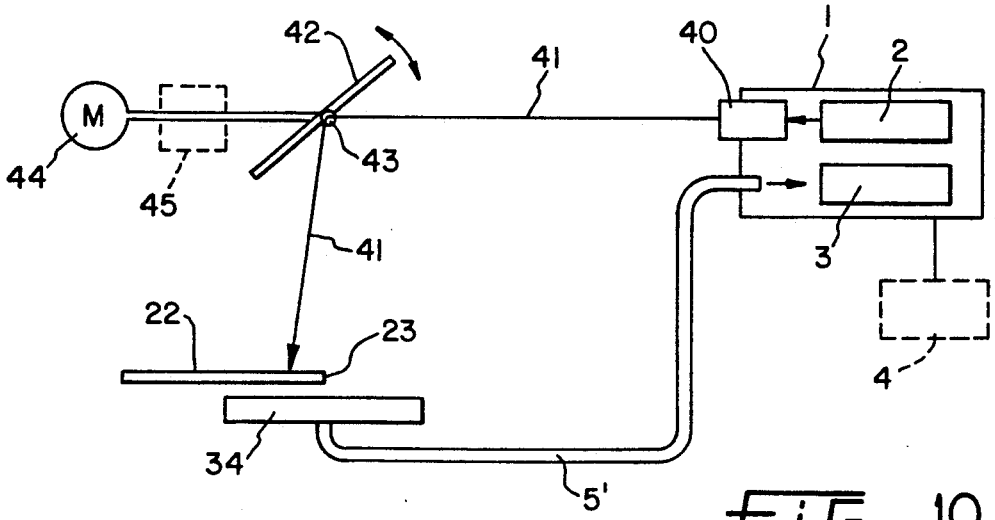
Figure 8:
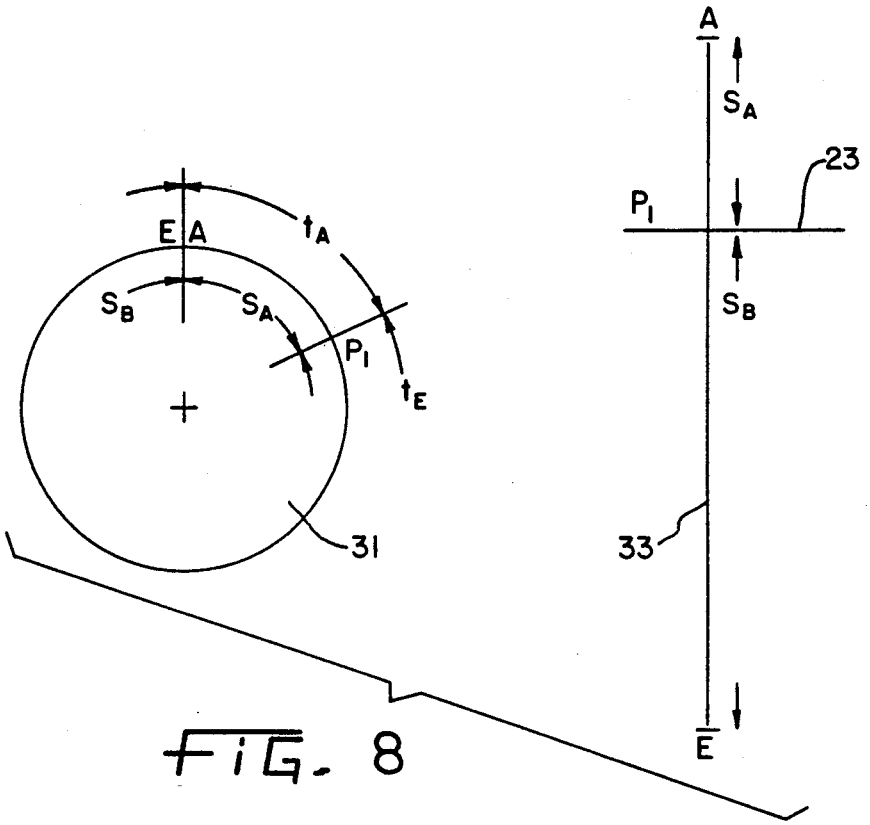
Figure 9:
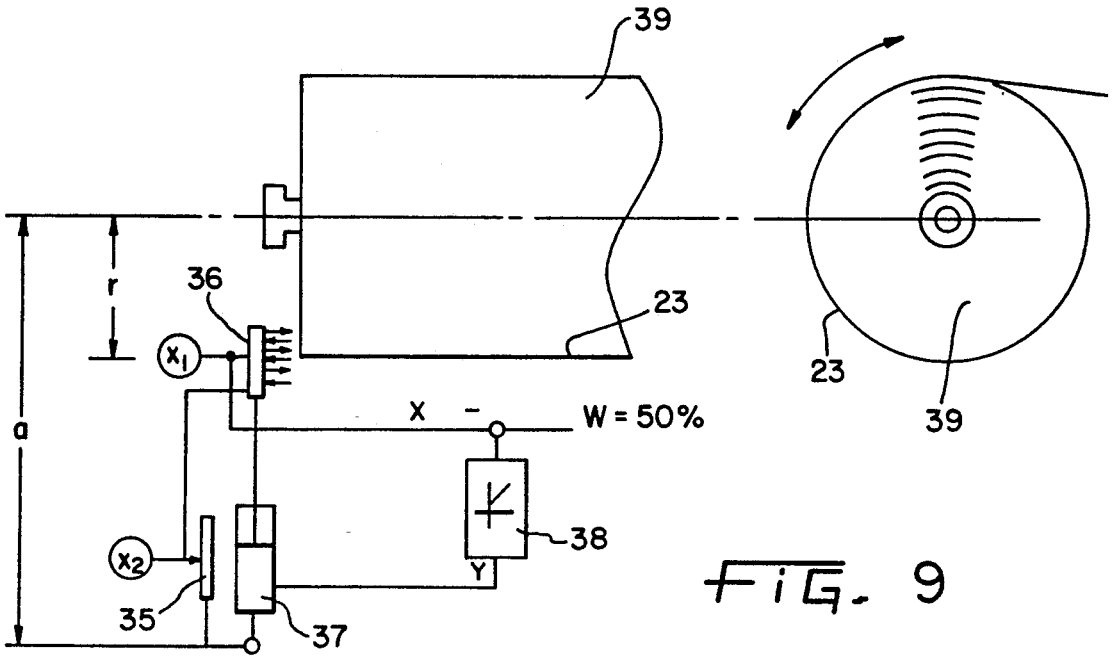

FIG. 1 shows a lateral, partially sectional view of a first embodiment of the inventional device;

FIG. 2, a section view along line II—II in FIG. 1;

FIG. 3, a basic sketch illustrating the mode of operation of the device acccording to FIG. 1;

FIG. 4, a basic sketch of a circuit in the evaluating device for determining the position of the web edge;

FIG. 5, a lateral, partly sectional view of another embodiment according to the invention;

FIG. 6, a basic sketch of the transmission distributing circle in the embodiment according to FIG. 5, in the direction of arrow VI;

FIG. 7, a basic sketch showing the correlations between transmission distributing circle and the linear transmission receiving strip in the embodiment according to FIG. 5;

FIG. 8, a sketch illustrating the operating mode of the embodiment according to FIG. 5;

FIG. 9, a basic sketch illustrating another application of the inventional device;

FIG. 10, a principle sketch of another embodiment of the inventional device, and FIG. 11, as well a principle sketch of an embodiment of the inventional device of a different design.

The embodiment of the inventional device illustrated in FIGS. 1 through 4 of the drawing features an infrared reflection relay which overall is marked 1 and which contains a transmitter 2 and a receiver 3. The reflection relay 1 is connected with an evaluating unit which overall is marked 4.

An optical fiber cable 5 which, as illustrated in FIG. 2, contains transmitting optical fibers 6 and receiving optical fibers 7 is connected with a drive 8 by which a scanning arm 9 is rotationally driven.

In the illustrated embodiment, the drive 8 is fashioned as an electromotor 10. Instead of the electromotor 10, also pneumatic motors, hydraulic motors or transmissions driven through a flexible shaft may be used as drive 8.

As shown in FIG. 1, the electromotor 10 is provided with a hollow shaft 11 through which extends the optical fiber bundle 5.

In the preferred embodiment according to FIG. 1, the optical fiber bundle 5 is accommodated, on the input side of the drive 8 or electric motor 10, in a housing part 12 of the motor in the stationary half (female) 13 of an optical rotary coupling 14. The opposite end 15 of the optical fiber bundle 5 is contained in a rotatable half 16 of the rotary coupling 14 which is fastened in the end 17 of the hollow shaft 11 opposite the stationary half 13.

The optical fiber bundle 5 extending through the hollow shaft 11 continues through the scanning arm 9 to an opening 18 on the free end of the scanning arm 9, in which the signal output 19 and signal input 20 symbolized by arrows in FIG. 1 are arranged. As illustrated, the arrangement is such that the light emission surface 21 on the free end of the scanning arm 9 will be perpendicular to the drive axle of the scanning arm 9 that is formed by the hollow shaft 11.

Marked 22 in FIG. 1, additionally, is the trajectory to be monitored, by which the position of the edge 23 is to be determined.

The embodiment illustrated in FIG. 1, with regard to its function, will be more fully explained hereafter with reference to FIGS. 3 and 4.

The drive 8 moves the signal output 19 and the signal input 20 on the scanning arm above the web 22 along a circular path 26 wherein, as illustrated in FIG. 3, there exist two points of intersection 24, 25 with the web edge 23. The radius r of the circular path 26 corresponds to the spacing between the center axis of the hollow shaft 11 and the center axis of the light-emitting opening 21. When the circular path 26 is intersected at one of the points 24, 25 by the web edge 23, the reflected light is transmitted through the receiving fibers 7 of the optical fiber bundle 5 to the transmitter 3 of the photoelectric relay 1.

By evaluating the change of state at the points of intersection 24, 25, the photoelectric relay 1 generates an on/off signal from which the evaluating unit 4 determines the angle of intersection $\alpha$ and computes from it the height of the circular segment h.

In the simplest case, the measurement of the angle can be performed by integration and averaging of a direct voltage switched by the photoelectric relay 1 at the pulse width repetition ratio, to which end, e.g., the simple circuit illustrated in FIG. 4 may be used. The voltage on the illustrated capacitor represents a measure for the angle. Marked 27, in FIG. 4, is the contact of the photoelectric relay 1.

Alternatively, the angle may be measured by determining the on/off intervals, with $Z_E$=time ON (covered)

$Z_A$=time OFF (exposed)

so that the angle can be calculated as follows:

$$\alpha = \frac{360^\circ}{1 + \frac{Z_E}{Z_A}} \quad \text{(I)}$$

or $$\overset{\Omega}{\alpha} = \frac{2\pi}{1 + \frac{Z_E}{Z_A}} \quad \text{(II)}$$

With the aid of the angle of intersection of $\alpha$ measured according to the first alternative or calculated according to the above equations, the evaluating unit 4 subsequently calculates the height of the circular segment h, where h=segment height r=radius of the circle described by the scanning arm 9

$\alpha$=angle of intersection and at that, according to the following equations:

$$h = r\left(1 - \cos\frac{\alpha}{2}\right) \quad \text{(III)}$$

$$h = r\left[1 - \cos\left(\frac{180^\circ}{1 + \frac{Z_E}{Z_A}}\right)\right] \quad \text{(IV)}$$

In the alternative embodiment of an inventional device as illustrated in FIGS. 5 through 7, the signal generated through the motion along a circular path is first converted to a linear trajectory.

As illustrated, the optical fiber bundle extending through the scanning arm 9 and through the optical rotary coupling 14 is connected with the transmitter 2 of the photoelectric relay 1. The scanning arm 9 runs in a housing part 28 in which, opposite from the circular path 26 of the light-emitting opening 21, the ends of the optical fiber bundles 13 are arranged that form a transmission distributing circle 31.

The other ends 32 of the connecting optical fiber bundle 30 are combined in a linear transmission strip 33 which, as illustrated in FIG. 5, is perpendicular to the web edge 23.

The receiver 3 of the photoelectric relay 1 connects through the optical fiber bundle 5' containing the receiving fibers 7 with an as well linear receiving strip 34 in which the free ends of the receiving fibers are combined in a linear arrangement, the receiver strip 34 being arranged parallel to the transmitter strip 33.

During the rotational motion of the scanning arm 9 generated by the drive 8, the light enters the ends 29 of the transmission fibers 6 of the connecting optical fiber bundle 30 and appears in the transmitter strip 33 in a linear arrangement, always according to the optical fiber addressed.

The receiver strip 34 collects the reflected light of the transmitter strip in accordance with the position of the web edge 23 and passes the reflected light through the optical fiber bundle 5' to the receiver 3 of the photoelectric relay 1.

In detail, the same as in the embodiment according to FIG. 1, the infrared light emitting from the photoelectric relay 1 is passed through the optical fiber bundle 5 to the light emission opening 21 of the scanning arm. With the drive 8 rotating, the light emitting from the light emission opening 21 enters the opposite optical fibers of the transmission distributing circle 31 successively in the direction of rotation and, as the rotary motion continues, emits as a linear motion on the transmission strip 33.

If an object capable of reflection, for instance the web 22 with the web edge 23, is located underneath the transmission strip 33, the reflected light is passed through the receiver strip 34 of the receiving lens of the photoelectric relay 1 and utilized by it. The change of state, reflection or no reflection, is converted by the photoelectric relay 1 to on/off signals.

The pulse width repetition ratio of the output signals of the photoelectric relay 1 is proportionally consistent with the arc on the transmission distributing circle 31 that is swept by the scanning arm 9.

For better clarity, the individual optical fibers are illustrated consecutively numbered, in FIG. 7, with the transmitting and receiving ranges 1 through 7 being exposed in the illustrated position, whereas the transmitting and receiving areas 8 through 26 are covered by the web, so that the web edge is located between 7 and 8.

The position of the web edge 23 can be determined as follows with the aid of the pulse width repetition ratio obtained through the on/off signals of the photoelectric relay 1, where U=circumference of the transmission distributing circle 31

$t_E$=time photoelectric relay covered $t_A$=time photoelectric relay exposed $S_E$=travel, photoelectric relay covered $S_A$=travel, photoelectric relay exposed.

The positions of these variables are shown in FIG. 8 with regard to the transmission distributing circle 31.

Under these conditions there is then:

$$S_A = \frac{U}{1 + \frac{Z_E}{Z_A}}$$

$$S_E = \frac{U}{1 + \frac{Z_A}{Z_E}}$$

In the simplest case, the travel can therefore be determined in the evaluation unit 4 by integration and averaging of a direct voltage that is switched by the photoelectric relay 1 at the pulse width repetition ratio, to which end, e.g., the circuit may be used that is shown as well in FIG. 4, with the voltage on the capacitor being directly proportional to the travel.

Schematically illustrated in FIG. 9 is yet another application in which coil diameters on winders and unwinders can be monitored in noncontact fashion with the embodiments described above, with the diagram according to FIG. 9 showing additionally the basic control circuit.

In FIG. 9, a marks the distance from a fixed point, r the radius of the angle, $x_1$ a travel 1 which is determined as a measured value, for instance by a mechanical transmitter, and $x_2$ a travel 2 which is obtained as a measured value by a transmitter that may correspond to one of the embodiments of the invention.

In FIG. 9, 35 marks the mechanical transmitter and 36 the optical transmitter according to the invention, with a piston 37 and a regulator 38 being provided additionally. The regulator 38 is a travel regulator for the sensor 36, which thereby is kept in a 50% position, i.e., in a middle position.

Thus, the radius r can be determined by the formula $$r = a - (x_1 + x_2).$$

Such a measuring arrangement with travel regulation offers the advantage that the material to be measured can be swept and that the tracing motions will be compensated for, since a change of the travel $x_1$ generates with a covered sensor of the optical transmitter 36 an opposite change of $x_2$.

In the embodiment of the device for determining the position as illustrated in FIG. 10, the transmitter 2 of the photoelectric relay 1 is designed to emit a light signal which through a lens 40 coordinated with the transmitter falls as a light ray (more exactly, a light bundle) on a plane mirror 42. This mirror is installed in the area of the web 22 in such a way that it can be swiveled about an axis 43 which extends parallel to the web edge 23. Connected with the plane mirror 42 is a drive motor 44 under the effect of which the mirror 42 performs an oscillating swivel motion about the axis 43. A drive mechanism 45 for controlling the swivel motion may be arranged in the drive train between the motor 44 and the mirror 42.

Extending perpendicularly to the swivel axis 43 and directed at it, the light beam 41 is reflected by the plane mirror 42 and directed toward the web 22. In the plane of the web 22, due to the swivel motion of the mirror 42, the light beam follows a rectilinear trajectory which intersects the web edge 23 at a right angle. During each complete cycle of the light beam 41, the web edge 23 is intersected twice.

On the side of the web 22 away from the plane mirror 42, near the web edge 23, there is the receiver strip 34 arranged, and at that, parallel to the trajectory of the light beam 41, which thus, in the absence of the web, falls on the receiver strip. From the receiver strip 34, the optical fiber cable 5' extends to the receiver 3 of the photoelectric relay 1. The receiver strip 34 may also be arranged beside the trajectory of the light beam 41, on the side of the web 22 facing the plane mirror 42. In the case of this arrangement, as the light beam 41 falls on the web 22, the strip 34 receives light reflected by the web and transmits it to the receiver 3 of the photoelectric relay 1. However, light reflected by the web 22 may be captured and transmitted to the transmitter 3 in other ways.

The web edge 23 can be determined at high accuracy through a light bundle 41 with a very small opening angle, through a light bundle which is limited in parallel fashion and has a very small diameter, or through a light bundle focused on the plane of the web 22. When the speed of motion of this light bundle, which above was termed light beam for simplification, is constant across the measuring area for locating the web edge, through appropriate control of the swivel motion of the plane mirror 42, the duration of the light/no light signals transmitted to the receiver can be utilized by the evaluating unit 4 with little expense for determining the actual value for locating the web edge 23.

The embodiment of the device illustrated in FIG. 11 differs from the one according to FIG. 10 only in that the plane mirror is substituted by a polygonal mirror 46. The latter is connected with a motor 47 and driven so as to rotate about an axis of rotation 48 that extends parallel to the web edge 22. The light beam 41 is reflected by each facet of the polygonal mirror 46 and passed across the web 22 along a trajectory that extends transverse to the web edge 23.

In the preceding, the invention was explained in principle with the aid of embodiments, with changes and modifications being obvious to the expert without leaving the basic idea of the invention such as expressed, among others, also in the process claims.

All of the features and advantages of the invention, including design details and the spatial arrangements deriving from the description, claims and the drawing can be inventionally essential both by themselves and in any combination.

We claim:

1. Device for determining the location of an edge of a moving web, comprising:

a photoelectric relay having adjacent the web edge a signal output emitting a light signal, and a signal input, the signal output and the signal input being connected with the photoelectric relay through an optical fiber bundle, said optical fiber bundle containing sending fibers and receiving fibers in a concentric arrangement; and a rotary drive which continuously moves the signal output and signal input along a trajectory which intersects the web edge at least twice, said drive including a continuous hollow shaft through which extends the optical fiber bundle which is connected with the photoelectric relay, and wherein the shaft of the drive includes a scanning arm mounted thereto through which extends the optical fiber bundle, said drive having a drive axis and said scanning arm having a free end on which there are provided the signal output and the signal input, the signal output having a light emission surface perpendicular to the drive axis.

2. Device according to claim 1, in which the drive has a housing part on an input side thereof in which the optical fiber bundle is accommodated in a stationary half of an optical rotary coupling, and the hollow shaft has a bordering end in which is provided a rotatable coupling half of the optical rotary coupling in which is accommodated an optical fiber bundle extending to the signal input and the signal output.

* * * * *